US006260306B1

(12) United States Patent
Swetish et al.

(10) Patent No.: US 6,260,306 B1
(45) Date of Patent: Jul. 17, 2001

(54) INFLATABLE SHELTER

(75) Inventors: Thomas R. Swetish; Steven G. Melnyk, both of Racine, WI (US)

(73) Assignee: Johnson Outdoors Inc., Sturtevant, WI (US)

( * ) Notice: Subject to any disclaimer, the term of this patent is extended or adjusted under 35 U.S.C. 154(b) by 0 days.

(21) Appl. No.: 09/307,507

(22) Filed: May 7, 1999

(51) Int. Cl.[7] ..... E04H 15/20

(52) U.S. Cl. ..... 52/2.18; 52/2.23; 52/2.24; 135/90; 135/96; 135/124

(58) Field of Search ..... 52/2.11, 2.14, 52/2.18, 2.22, 2.23, 2.24; 135/90, 96, 124, 125, 127, 115; 446/227

(56) References Cited

U.S. PATENT DOCUMENTS

| | | | | |
|---|---|---|---|---|
| D. 408,192 | * | 4/1999 | Chiang | D6/596 |
| 2,946,337 | | 7/1960 | Woshin . | |
| 2,955,606 | | 10/1960 | Walker . | |
| 3,899,853 | | 8/1975 | Wertman . | |
| 3,999,333 | | 12/1976 | Amarantos . | |
| 4,121,604 | * | 10/1978 | Rain | 135/124 |
| 4,269,210 | | 5/1981 | Marks . | |
| 4,408,260 | | 10/1983 | Miedel . | |
| 4,876,829 | | 10/1989 | Mattick . | |
| 4,959,901 | | 10/1990 | Parish . | |
| 5,007,212 | | 4/1991 | Fritts et al. . | |
| 5,311,706 | | 5/1994 | Sallee . | |
| 5,331,991 | | 7/1994 | Nilsson . | |
| 5,396,917 | * | 3/1995 | Hazinski et al. | 135/125 |
| 5,487,400 | | 1/1996 | Dawkins . | |
| 5,570,544 | | 11/1996 | Hale et al. . | |
| 6,109,280 | * | 8/2000 | Custer | 135/116 |

FOREIGN PATENT DOCUMENTS

| | | | | |
|---|---|---|---|---|
| 836294 | * | 3/1970 | (CA) | 52/2.18 |
| 1104920 | * | 11/1955 | (FR) | 52/2.18 |
| 6280425 | * | 10/1994 | (JP) | 52/2.11 |
| WO 86/00952 | * | 2/1986 | (WO) | 52/2.18 |

OTHER PUBLICATIONS

Johnson Worldwide Associates Eureka Catalog—"Twin Tube Frame Tents" (12 pages).

Johnson Worldwide Associates Eureka Catalog—"Genesis, Elite and Capri Tents, Party Tents and Canopies" (8 pages).

* cited by examiner

*Primary Examiner*—Beth A. Stephan
*Assistant Examiner*—Winnie Yip
(74) *Attorney, Agent, or Firm*—Foley & Lardner

(57) ABSTRACT

An inflatable shelter includes a flexible membrane, a first elongate inflatable tube supported by the flexible membrane and a second elongated inflatable tube supported by the flexible membrane. The first tube has first and second axial ends and a first intermediate portion between the first and second axial ends. The second tube has third and fourth axial ends and a second intermediate portion between the third and fourth axial ends. The first, second, third and fourth axial ends terminate in a plane. The first and second intermediate portions converge towards one another such that the first and second tubes form four legs supporting the membrane. The flexible membrane preferably includes first and second sleeves defining first and second lumens receiving the first and second inflatable tubes, respectively, and a plurality of wall panels coupled to and extending between the first and second sleeves. The first and second lumens of the first and second sleeves are separated by at least one divider panel extending substantially parallel to the first and second tubes. The first and second tubes are insertable into and removable from the first and second sleeves, respectively, such that the first and second tubes are replaceable.

30 Claims, 4 Drawing Sheets

INFLATABLE SHELTER

FIELD OF THE INVENTION

The present invention relates to shelters, such as tents and canopies, formed from flexible membranes. In particular, the present invention relates to an inflatable shelter that has few parts, that is simple to manufacture and that is to easy to set up and repair.

BACKGROUND OF THE INVENTION

Portable shelters, such as tents and canopies, are employed to provide cover and protection from the elements such as sun, rain and wind. Such portable shelters generally include a flexible lightweight membrane, such as canvas, which is supported by poles or inflated members. Although more easily erected as compared to pole supported shelters, inflatable shelters are typically more expensive to manufacture, are more subject to failure and are more difficult to repair. Conventional inflatable shelters utilize either a single extremely complex shaped inflatable member or multiple tubes that have axial ends that converge at the apex of the shelter or that overlap one another at the apex of the shelter. Shelters that employ a single inflatable member are extremely complex and difficult to manufacture. Moreover, once damaged, the entire shelter must be replaced. Shelters employing multiple tubes that have axial ends converging at the apex of the structure require a greater number of parts, are time consuming to assemble and are subject to leakage. Shelters employing multiple tubes that overlap one another at the apex of the structure result in the outer perimeter of the shelter being multi-tiered such that the shelter is difficult to cover with a fly. Moreover, such shelters are unattractive due to the outer surface discontinuity.

As a result, there is a continuing need for an inflatable structure or shelter that is easy to manufacture, requires fewer parts, is easy to assemble, is easily erected and is easily repaired.

SUMMARY OF THE INVENTION

The present invention provides an inflatable shelter that includes a flexible membrane, a first elongate inflatable tube supported by the flexible membrane and a second elongate inflatable tube supported by the flexible membrane. The first tube has first and second axial ends and a first intermediate portion between the first and second axial ends. The second tube has third and fourth axial ends and a second intermediate portion between the third and fourth axial ends. The first, second, third and fourth axial ends terminate in a plane. The first and second intermediate portions converge towards one another such that the first and second tubes form four legs supporting the membrane.

The present invention also provides for an inflatable shelter including a first sleeve defining a first lumen, a second sleeve defining a second lumen, a first inflatable tube received within the first lumen, and a second inflatable tube received within the second lumen. The first sleeve has first and second axial ends and a first intermediate portion between the first and second axial ends. The second sleeve has third and fourth axial ends and a second intermediate portion between the third and fourth axial ends. The first and second intermediate portions converge. The first and second lumens are separated by at least one divider panel extending parallel to the first and second lumens.

The present invention also provides an inflatable shelter including a plurality of sleeves defining a plurality of lumens, a plurality of wall panels coupled to and extending between the plurality of sleeves and a plurality of elongate inflatable tubes disposed within the plurality of sleeves, respectively. Each of the plurality of tubes are insertable into and removable from the plurality of sleeves such that each of the plurality of tubes may be replaced.

The present invention also provides a shelter shell for being supported by a plurality of inflatable tubes, whereby inflation of the tubes supports the shell. The shelter shell includes a plurality of sleeves providing a plurality of lumens configured to removably receive the plurality of inflatable tubes, respectively, and a plurality of wall panels coupled to and extending between the plurality of sleeves. Each of the sleeves is preferably air permeable and is configured to completely surround a circumference of the tube disposed therein.

DETAILED DESCRIPTION OF THE PREFERRED EMBODIMENTS

Figure 1:
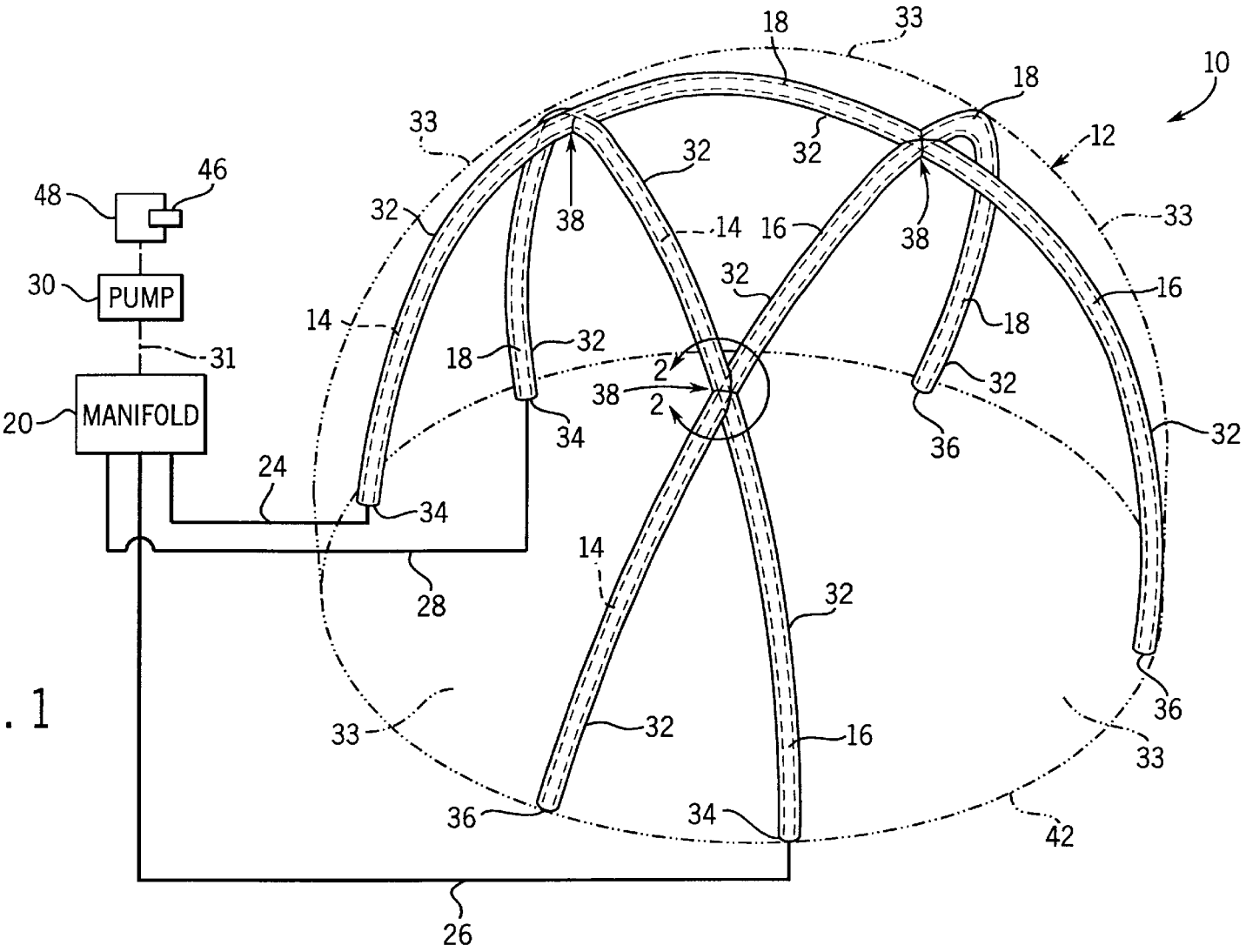
FIG. 1 is a perspective view schematically illustrating an inflatable shelter supported by a plurality of inflatable tubes in an inflated state.

FIG. 1 is a perspective view schematically illustrating an inflatable shelter 10 in an inflated state. As shown by FIG. 1, shelter 10 generally includes cover or membrane 12, inflatable tubes 14, 16, 18, manifold 20, inflation lines 24, 26, 28 and pump 30. Membrane 12 comprises a flexible sheet or a series of sheets stitched, bonded or otherwise connected together to form sleeves 32 and panels 33. Sleeves 32 comprise fabric tubes sized to receive inflatable tubes 14, 16 and 18. Sleeves 32 extend between and are interconnected to panels 33. Sleeves 32 provide a flexible and collapsible framework for panels 33 and the remainder of shelter 10. Upon inflation of tubes 14, 16 and 18 within sleeves 32, sleeves 32 rigidify to support panels 33.

Panels 33 comprise single sheets which are stitched or otherwise affixed to and between sleeves 32. Panels 33 provide a majority of the covering provided by shelter 10. Panels 33 are preferably formed from a water resistant, yet breathable imperforate fabric. Alternatively, panels 33 may be at least partially formed from a perforated fabric. For example, when used as a tent shelter, panels 33 may include portions which are perforated to provide increased ventilation to the interior of shelter 10. In such embodiments, imperforate or water resistant or panels may be additionally positioned over the perforated portions of panels 33 to prevent the ingress of water and moisture. In the exemplary embodiment, panels 33 are formed from a typical tent material having a relatively large degree of flexibility such as breathable nylon.

Tubes 14, 16 and 18 (schematically shown in FIG. 1) are substantially identical to one another and comprise individual inflatable members having axial ends 34, 36 and intermediate portions 38. Axial ends 34 and 36 of each tube 14, 16, 18 terminate in a single plane 42. Depending upon the particular application of shelter 10, plane 42 will either extend along the ground or other surface supporting shelter 10 or will comprise a lower most extending portion of a roof or cover which is elevated above the ground by poles or additional inflatable structures.

As further shown by FIG. 1, each tube 14, 16, 18 extends along a generally arcuate path such that intermediate portions 38 converge towards one another above plane 42. As a result, tubes 14, 16, 18, upon being inflated, form a self-supporting framework which is stronger at the junctions of intermediate portions 38 to better carry loads placed upon shelter 10. In addition, each individual tube 14, 16, 18 provides multiple legs of the framework. As a result, shelter 10 requires fewer parts, is less expensive to manufacture, is easier to assemble and is less prone to damage or leakage.

Manifold 20 directs pressurized air via inflation lines 24, 26, 28 to each of tubes 14, 16, 18 to inflate tubes 14, 16, 18. Manifold 20 is configured to simultaneously inflate tubes 14, 16 and 18. Alternatively, manifold 20 may be configured to provide selective and independent inflation of tubes 14, 16 and 18. Although less desirable, manifold 20 may be omitted, whereby tubes 14, 16 and 18 would have to be individually inflated one at a time.

Pump 30 is conventionally known and provides pressurized air to manifold 20. Pump 30 preferably comprises an electrically powered air pump. In the exemplary embodiment, pump 30 includes a conventionally known electrical connector 46 configured for being plugged into a conventional vehicle cigarette lighter 48. As a result, shelter 10 may be easily inflated at a remote location where electrical outlets are not available by simply plugging pump 30 into cigarette lighter 48 of a vehicle. Alternatively, shelter 10 may be provided with other mechanisms for providing pressurized air to manifold 20 and tubes 14, 16 and 18. For example, pump 30 may alternatively comprise a manually actuated air pump or an air compressor.

Figure 2:
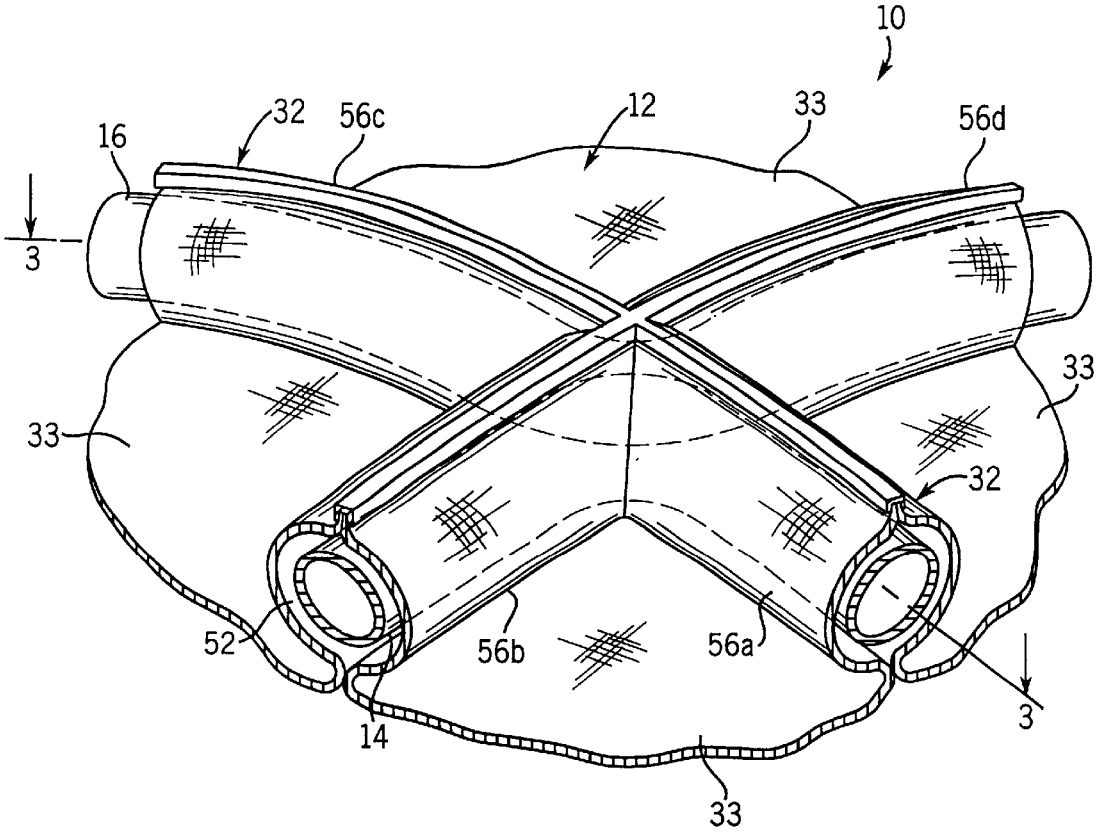
FIG. 2 is a fragmentary perspective sectional view of the shelter of FIG. 1 taken along lines 2—2.
Figure 3:
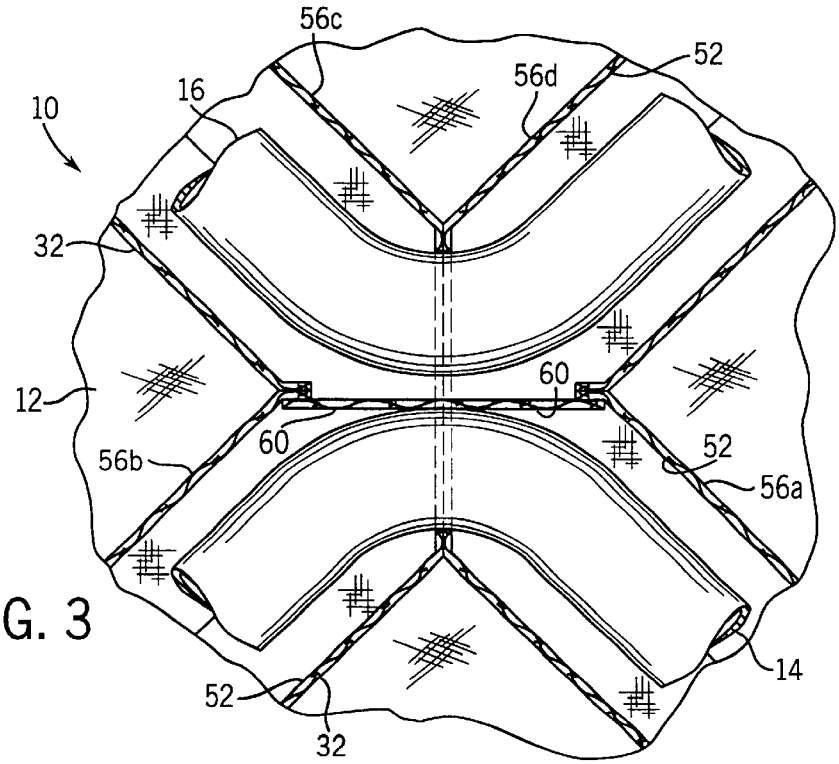
FIG. 3 is a fragmentary sectional view of the shelter of FIG. 2 taken along lines 3—3.

FIGS. 2 and 3 illustrate sleeves 32 of membrane 12 and intermediate portions 38 of tubes 14 and 16 in greater detail. FIG. 2 is a fragmentary perspective view of shelter 10 taken along lines 2—2 of FIG. 1. FIG. 3 is a fragmentary sectional view of shelter 10 taken along lines 3—3 of FIG. 2. As shown by FIGS. 2 and 3, sleeves 32 are generally tubular walls which define inner lumens 52 that receive tubes 14, 16 and 18 (shown in FIG. 1). Sleeves 32 are preferably formed from a non-stretchable material. In the exemplary embodiment, sleeves 32 are formed from sail cloth or Dacron. Each lumen 52 has a diameter less than or equal to the maximum diameter of each of tubes 14, 16, 18 when inflated. As a result, sleeves 32 prevent tubes 14, 16, 18, which preferably comprise bladders, from being over-inflated. Sleeves 32 also protect tubes 14, 16 and 18 from abrasion and other damage. Moreover, because sleeves 32 are not required to be airtight, sleeves 32 are still functional despite minor abrasion and wear over time. When normally and safely inflated, tubes 14, 16 and 18 have maximum outer diameter greater than the inner diameter of sleeves 32. Although not shown in a fully inflated state, tubes 14, 16 and 18, upon being sufficiently inflated, expand against the tubular walls forming sleeves 32 to place sleeves 32 and panels 33 in tension for increased strength and load capacity. Although sleeves 32 are illustrated as being formed from fabric sheet sewn together and further sewn to panels 33 extending between sleeves 32, sleeves 32 may alternatively be formed as part of a single fabric sheet or may be independently formed and secured to membrane 12 by various other attachment methods such as stitching, heat welding, adhesives or fasteners. Although less desirable, inflatable tubes 14, 16 and 18 may alternatively have a maximum outer diameter less than or substantially equal to the inner diameter of sleeves 32, whereby the tubes, upon being inflated, support sleeves 32 and panels 33 without placing sleeves 32 and panels 33 in great tension.

As best shown by FIG. 3, sleeves 32 preferably include multiple branches or segments 56. Each segment 56 extends between the junctions of intermediate portions 38 at which the segments 56 angle away from one another. For example, at the junction of intermediate portions 38 of tubes 14 and 16, shelter 10 includes four sleeve segments 56*a*, 56*b*, 56*c* and 56*d*. Sleeve segments 56*a* and 56*b* provide an elongate continuous lumen 52 which receives tube 14. Sleeve segments 56*c* and 56*d* provide an elongate continuous lumen 52 which receives tube 16. As shown by FIG. 3, segments 56*a*, 56*b*, 56*c* and 56*d* are interconnected with one another in a generally X-shaped configuration such that the continuous lumens 52 provided by segments 56*a*, 56*b* and segments 56*c* and 56*d* converge towards one another. As a result, intermediate portions 38 of tubes 14 and 16 converge towards one another. More importantly, segments 56*a* and 56*b* retain tube 14 along a non-linear axis while segments 56*c* and 56*d* retain tube 16 along a non-linear axis. As a result, tubes 14 and 16 may comprise inexpensive elongate linear bladders or tubes which are inserted through the sleeves prior to inflation. In addition, tubes 14 and 16 may be easily removed from sleeves 32 for replacement or repair.

As further shown by FIG. 3, sleeves 32 include a divider panel 60 extending between the lumens 52 provided by segments 56*a*, 56*b*, 56*c*, 56*d*. Divider panel 60 preferably extends parallel or tangent to adjacent portions of tubes 14 and 16. Divider panel 60 is preferably formed from the same material as that of sleeves 32 and membrane 12. In particular, divider panel 60 is formed from a flexible sheet of material which is generally unstretchable. Alternatively, divider panel 60 may be formed from a variety of alternative materials. Divider panel 60 serves as a partition between the lumen 52 provided by segments 56*a*, 56*b* and the lumen provided by segments 56*c*, 56*d* to prevent over-inflation of either of tubes 14 and 16 while permitting tubes 14 and 16 to extend as close as possible to one another so as to produce a stronger, more rigid and more visually appealing junction. In addition, because tubes 14 and 16 extend adjacent one another in a side-by-side relationship without vertically overlapping one another, the outer perimeter of shelter 10 is cleaner such that supplemental covers such as flys may be more easily positioned over shelter 10. Although sleeves 32 are illustrated as including a single divider panel 60 at the junction of segments 56*a*, 56*b*, 56*c* and 56*d*, sleeves 32 may alternatively include more than one divider panel 60. For example, segments 56*a*, 56*b* may be continuously joined and segments 56*c*, 56*d* may be continuously joined, wherein the wall joining segments 56*a*, 56*b* is fastened to the wall joining segments 56*c*, 56*d* such that the two walls partition the side-by-side lumens from one another.

Figure 4:
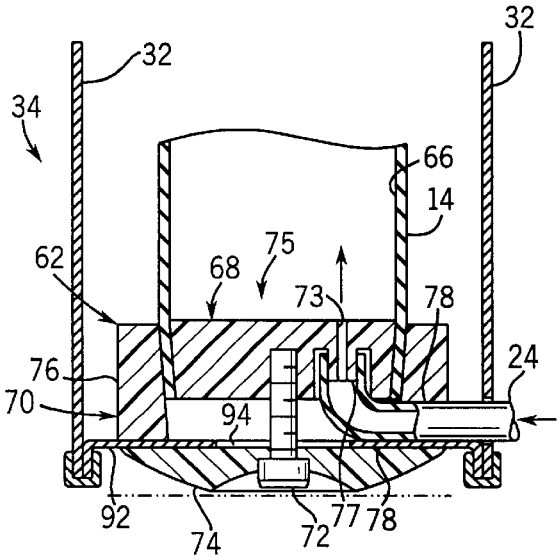
FIG. 4 is a sectional view of a first axial end of one of the inflatable tubes of FIG. 1.
Figure 5:
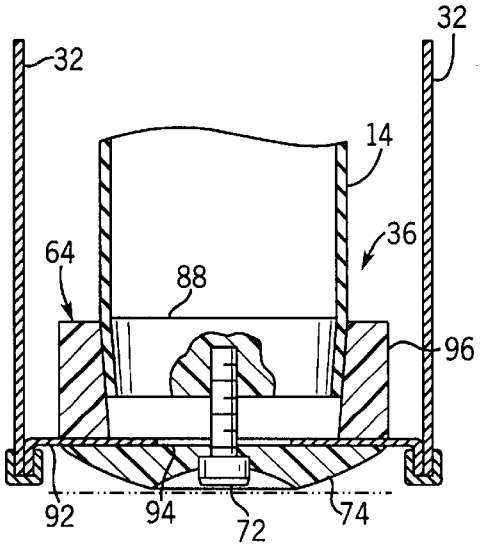
FIG. 5 is a sectional view of a second axial end of the inflatable tube of FIG. 4.

FIGS. 4 and 5 illustrate opposite axial ends 34, 36 of tube 14 in greater detail. As shown by FIG. 4, axial end 34 of tube 14 is axially sealed by cap 62 but includes an inflation port 73 through which the interior 66 of tube 14 is inflated. As shown by FIG. 5, axial end 36 of tube 14 is completely sealed by cap 64. In the exemplary embodiment, cap 62 generally includes plug 68, closure 70 and fastener 72. Plug 68 comprises a member having an outer diameter sized for being received in the axial end of tube 14. Plug 68 defines inflation portion 64 and includes a nipple 77 adapted for being connected to inflation line 24.

Closure 70 is a generally cup-shaped member having a bottom 74, an annular portion 76 and a passage 78 through which inflation line 24 extends to be connected to nipple 77 of plug 68. Annular portion 76 has an inner diameter greater than the outer diameter of tapered plug 68. As shown by FIG. 4, annular portion 76 and plug 68 cooperate to capture the wall of tube 14 therebetween. In the exemplary embodiment, plug 68 is tapered so as to have an enlarged diameter at end 75 such that as plug 68 is drawn towards bottom 74 of closure 70, tube 14 is compressed between plug 68 and annular portion 76. As will be appreciated, annular portion 76 or both annular portion 76 and plug 68 may alternatively be tapered or otherwise provided with an enlarged diameter at one end such that tube 14 is compressed between plug 68 and annular portion 76 as plug 68 and closure 70 are drawn towards one another.

Fastener 72 interconnects plug 68 to closure and draws plug 68 towards closure 70. Fastener 72 preferably comprises a threaded member which is threadably received within plug 68 and which upon being rotated draws plug 68 towards bottom 74.

FIG. 5 illustrates axial end 36 of tube 14. As shown by FIG. 5, axial end 36 includes cap 64. Cap 64 is identical to cap 62 except that cap 64 includes plug 88 in lieu of plug 68 closure 90 including annular portion 96 in lieu of annular portion 76. Plug 88 and closure 90 are identical to plug 68 and closure 70 except that plug 88 is generally imperforate so as to completely occlude the axial end of tube 14. Annular portion 96 omits passage 78.

As further shown by FIGS. 4 and 5, sleeve 32 receives axial ends 34 and 36 of tube 14 as well as a majority of closure 70. Each end of sleeve 32 includes an end flap 92 which extends across axial ends of sleeve 32. Each end flap 92 is preferably made of the same material as the remainder of sleeve 32 and is secured by stitching to the remainder of sleeve 32. Each end flap 92 includes an opening 94 sized to enable tube 14 with either plug 68 and annular portion 76 or plug 88 and annular portion 96 to be inserted therethrough. During insertion, plug 68 and 88 and annular portion 76 and 96 are turned sideways. Once inserted plug 68, 88 and annular portion 76, 96 are reoriented to face bottom 74 with flap 92 captured between bottom 74 and annular portion 76 at end 34 or annular portion 96 at end 36. As a result, as fastener 72 draws either plug 68 or 88 towards bottom 74, fastener also secures flap 92 and sleeve 32 to closures 70 and 90. End flaps 92 assist in maintaining the shape of sleeve 32 when tube 14 is fully inflated against sleeve 32 to place sleeve 32 in tension. End flaps 92 further prevent tube 14 from extending past the axial ends of sleeves 32 when fully inflated.

Overall, caps 62 and 64 enable shelter 10 to utilize elongate inflatable tubes or hoses having open axial ends. Consequently, the manufacture of shelter 10 is simpler and less expensive. Moreover, because caps 62 and 64 may be easily disconnected from tube 14, caps 62 and 64 may be reused when tube 14 is replaced. Although not illustrated in detail, the axial ends 34 and 36 of tubes 16 and 18 are identical to the axial ends 34 and 36 of tube 14, respectively.

Figure 6:
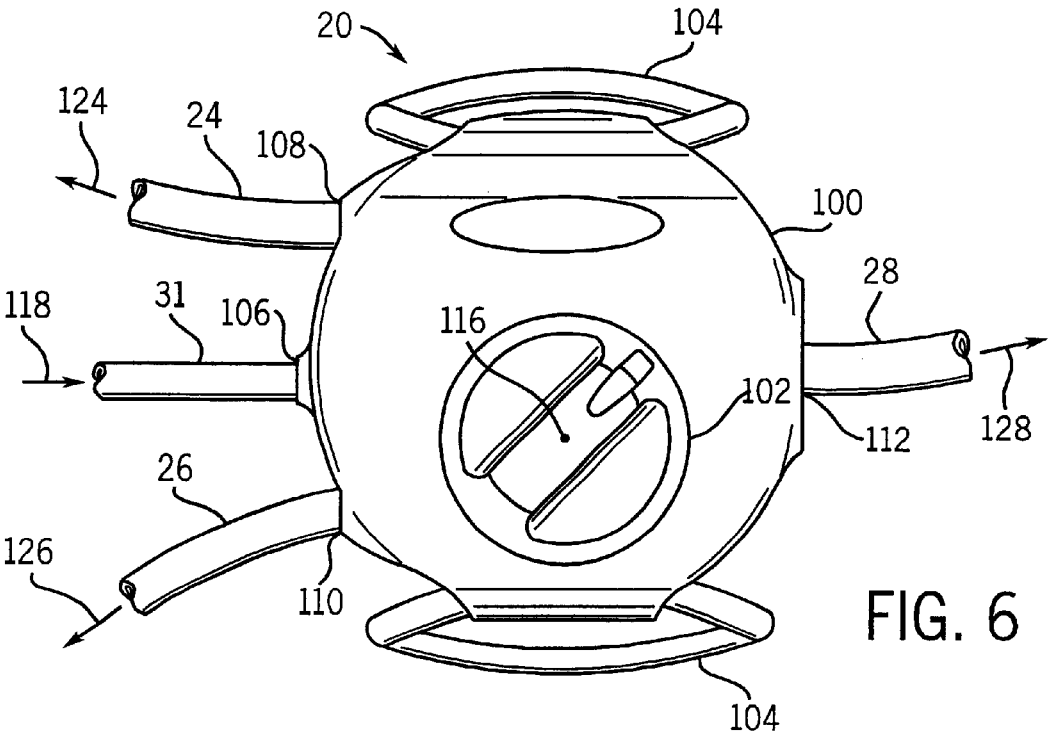
FIG. 6 is a fragmentary top elevational view of an exemplary manifold and set of air lines of the shelter of FIG. 1.
Figure 7:
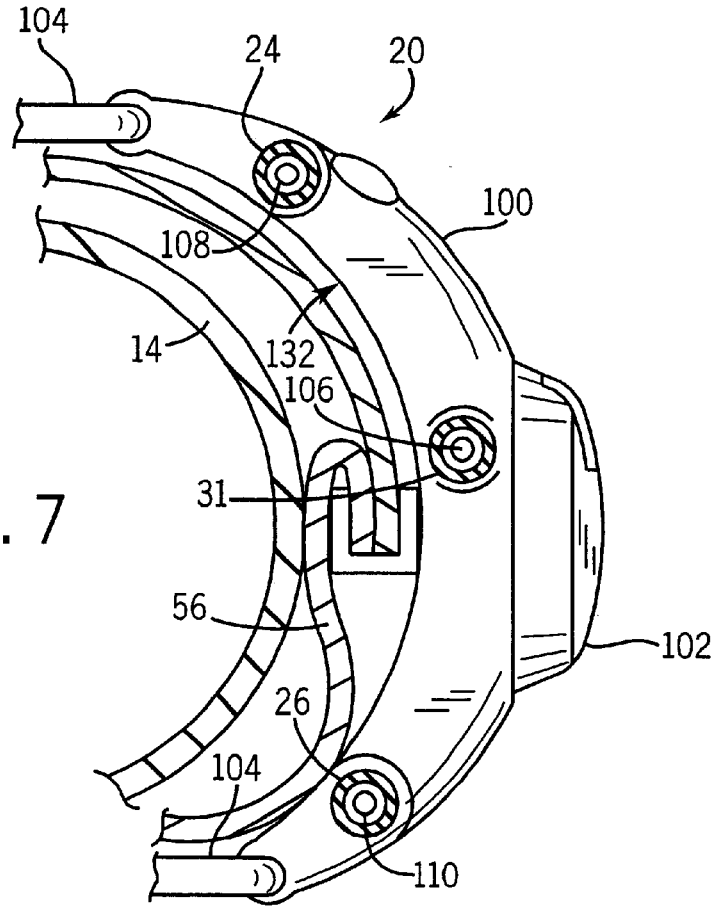
FIG. 7 is a side elevational view of the manifold of FIG. 6 with the air lines shown in section.

FIGS. 6 and 7 illustrate an exemplary embodiment of manifold 20 and air supply lines 24, 26 and 28 in greater detail. As shown by FIGS. 6 and 7, manifold 20 generally includes housing 100, valve actuator 102, and connectors 104. Housing 100 forms the main body of manifold 20 and defines an inlet port 106 and three outlet ports 108, 110 and 112 which communicate with an internally defined and conventionally known valve mechanism (not shown) situated between port 106 and ports 108, 110, 112. Port 106 receives air intake line 31 extending from pump 30 (shown in FIG. 1). Ports 108, 110 and 112 provide openings by which air lines 24, 26 and 28 are connected.

Actuator 102 preferably comprises a large ergonomic knob connected to the internal valve. Rotation of actuator 102 about axis 116 moves the internal valve between a closed position in which pressurized air flowing through line 31 from pump 30 as indicated by arrow 118 is sealed or closed off from air lines 24, 26 and 28, and an opened position in which air line 31 pneumatically communicates with each of air lines 24, 26 and 28 such that pressurized air provided by pump 30 through line 31 further flows through air lines 24, 26 and 28 as indicated by arrows 124, 126 and 128, respectively, to simultaneously inflate each of tubes 14, 16 and 18, respectively. Although actuator 102 and the internally formed, conventionally known valve are illustrated and described as being configured for providing the aforementioned closed and opened states wherein pressurized air is simultaneously supplied to each of air lines 24, 26 and 28, actuator 102 and the internally formed valve may alternatively be configured, in a conventionally known manner, to have multiple positions wherein pressurized air may be supplied to air lines 24, 26 and 28 simultaneously as well as independently of one another.

As best shown by FIG. 7, housing 100 of manifold 20 preferably has a concave side 132 such that housing 100 conforms to the diameter of one of sleeves 32 when one of tubes 14, 16 or 18 is inflated. As a result, manifold is more visually appealing when positioned adjacent to shelter 10. In addition, manifold 20 may be more easily secured and reliably mounted to shelter 20 by connectors 104.

Connectors 104 secure manifold 20 to shelter 10. At the same time, connectors 104 enable manifold 20 to be disconnected from shelter 10 such as when shelter 10 is being collapsed for storage or transportation or such as when either shelter 10 or manifold 20 requires repair or replacement. Connectors 104 preferably comprise conventionally known shock cords which are snapped inside housing 100. As a result, connectors 104 releasably secure manifolds 20 to shelter 10 regardless of whether shelter 10 is in an inflated or a deflated state. Furthermore, because connectors 104 preferably comprise shock cords, connectors 104 reliably connect manifold 20 to shelter 10 without any rigid or sharp protruding edges which could puncture membrane 12 and without the need for rigid fasteners or other adhesives. Although less desirable, manifold 20 may be otherwise secured to shelter 10 utilizing adhesives, fasteners or other mounting mechanisms.

Although the present invention has been described with reference to preferred embodiments, workers skilled in the art will recognize that changes may be made in form and detail without departing from the spirit and scope of the invention. The present invention described with reference to the preferred embodiments and set forth in the following claims is manifestly intended to be as broad as possible. For example, unless specifically otherwise noted, the claims reciting a single particular element also encompass a plurality of such particular elements.

What is claimed is:

1. An inflatable shelter comprising:

a flexible membrane;

a first elongate inflatable tube supporting the flexible membrane, the first tube having first and second axial ends, a first intermediate portion and a second intermediate portion between the first and second axial ends; and a second elongate inflatable tube supporting the flexible membrane, the second tube having third and fourth axial ends, and a third intermediate portion and a fourth intermediate portion between the third and fourth axial ends;

a third elongate inflatable tube supporting the flexible membrane, the third tube having fifth and sixth axial ends, and a fifth intermediate portion and a sixth intermediate portion between the fifth and sixth axial ends, wherein the first, second, third, fourth, and fifth and sixth axial ends terminate in a plane, wherein the first intermediate portion converges with the third intermediate portion at a first junction, wherein the second intermediate portion converges with the fifth intermediate portion at a second junction spaced from the first junction, wherein the fourth intermediate portion converges with the sixth intermediate portion at a third junction spaced from the first junction and the second junction such that the first, second and third tubes form six legs supporting the membrane.

2. The shelter of claim 1 wherein the membrane includes:

first, second, and third sleeves defining first, second, and third lumens receiving the first, second, and third inflatable tubes, respectively; and a plurality of wall panels coupled to and extending between the first, second, and third sleeves.

3. The shelter of claim 2 wherein the first, second, and third inflatable tubes are insertable into and removable from the first, second, and third sleeves, respectively, whereby the first, second, and third tubes are replaceable.

4. The shelter of claim 2 wherein the first inflatable tube is attached to the first sleeve only at the first and second axial ends of the first tube and wherein the first and second axial ends are releasably connected to the first sleeve, whereby the first tube may be removed from the first sleeve upon detachment of the first and second axial ends from the first sleeve.

5. The shelter of claim 2 wherein the first and second sleeves, the second and third sleeves, and the first and third sleeves converge toward one another at said first, second, and third junctions, respectively, and wherein the first, second, and third lumens are separated by at least one divider panel extending substantially parallel to the first, second, and third tubes between opposing wall portions of the first, second, and third tubes, respectively.

6. The shelter of claim 2 wherein the first sleeve includes first and second segments extending along non-coincident intersecting axes to retain the first tube along a non-linear axis when inflated.

7. The shelter of claim 6 wherein the second sleeve includes third and fourth segments extending along non-coincident intersecting axes to retain the second tube along a non-linear axis when inflated.

8. The shelter of claim 7 wherein the first, second, third and fourth segments of the first and second sleeves intersect one another at said first junction and wherein the shelter includes a divider panel extending between the first and second segments and the third and fourth segments at the junction.

9. The shelter of claim 2 wherein the first and second lumens of the first and second sleeves each have an inner diameter and wherein the first and second inflatable tubes each comprise a bladder which has a maximum outer diameter greater than the inner diameter of the first and second lumens, whereby the first and second tubes expand against the first and second sleeves, respectively, upon being sufficiently inflated.

10. The shelter of claim 2 wherein the panels have interior sides facing one another and opposite exterior sides and wherein the first and second sleeves extend along the exterior sides of the panels.

11. The shelter of claim 1 wherein the first tube includes a first inflation port adjacent the first axial end.

12. The shelter of claim 11 wherein the second axial end of the first tube is sealed.

13. The shelter of claim 11 including a cap sealing the first axial end, wherein the cap includes an inflation port.

14. The shelter of claim 12 including a cap sealing the second axial end.

15. The shelter of claim 12 including:

a first cap sealing the first axial end of the first tube, wherein the first cap includes an inflation port; and a second cap sealing the second axial end of the first tube, wherein the first and second caps are removably coupled to the first and second axial ends of the first tube, respectively.

16. The shelter of claim 15 wherein the first cap includes:

a plug removably fitted within the first axial end of the first tube; and an annular ring receiving the plug with the first axial end of the first tube captured between the plug and annular ring.

17. The shelter of claim 16 including:

a sleeve receiving the first tube; and a bottom member coupled to the cap, wherein the sleeve is captured between the bottom member and the annular ring.

18. The shelter of claim 17 wherein the annular ring has a tapered inner circumferential surface, wherein the plug has a tapered outer circumferential surface and wherein the bottom member is coupled to the plug by a movable member such that movement of the movable member draws the plug against the ring to compress the first tube therebetween.

19. The shelter of claim 1 wherein the first and third axial ends of the first and second tubes have first and second inflation ports, respectively.

20. The shelter of claim 19 wherein the second and fourth axial ends of the first and second tubes are sealed.

21. The shelter of claim 20 including a central manifold pneumatically coupled to the first and second inflation ports.

22. The shelter of claim 21 including a pneumatic pump coupled to the manifold.

23. The shelter of claim 22 wherein the pump is configured to be powered by a vehicle cigarette lighter.

24. The shelter of claim 21 wherein the shelter includes a sleeve receiving the first tube, wherein the sleeve has a diameter upon inflation of the first tube, and wherein the manifold has a concave side that conforms to the diameter of the sleeve when the first tube is inflated.

25. An inflatable shelter comprising:

at least one flexible membrane;

a first sleeve coupled to the at least one flexible membrane and defining a first lumen and having first and second axial ends and a first intermediate portion between the first and second axial ends;

a second sleeve coupled to the at least one flexible membrane and defining a second lumen and having third and fourth axial ends and a second intermediate portion between the third and fourth axial ends, wherein the first and second intermediate portions converge and are joined to one another at a junction spaced from the at least one flexible membrane, said first and second sleeves having joints spaced a part at said junction, wherein the first and second lumens are separated by at least one divider panel extending non-parallel to the at least one flexible membrane; and connecting said joints between said first and second sleeves at said junction a first inflatable tube received within the first lumen; and a second inflatable tube received within the second lumen, wherein the first tube includes a first wall portion at the junction, wherein the second tube includes a second wall portion facing the first wall portion at the junction, and wherein the at least one divider panel includes a divider portion extending tangentially between the first wall portion and the second wall portion.

26. The shelter of claim 25 wherein the first sleeve and the second sleeve are formed from a non-stretchable material, wherein the first and second lumens have first and second inner diameters and wherein the first tube and the second tube have first and second outer diameters greater than the first and second inner diameters, respectively, when fully inflated.

27. An inflatable shelter comprising:

a plurality of sleeves defining a plurality of lumens, the plurality of sleeves including a first sleeve and a second sleeve;

a plurality of wall panels coupled to and extending between the plurality of sleeves;

a plurality of elongate inflatable tubes removably positioned within the plurality of sleeves, whereby each of the plurality of tubes is replaceable, the plurality of tubes including a first tube having an axial end and a second tube positioned within the first sleeve and the second sleeve, respectively;

a plug removably fitted within the axial end of the first tube; and an annular ring receiving the plug with the axial end of the first tube captured between the plug and annular ring to seal the axial end of the first tube.

28. The shelter of claim 27 wherein each of the plurality of tubes has a first axial end and a second axial end, wherein only the first and second axial ends are detachably connected to at least one of the plurality of wall panels and the plurality of sleeves, whereby selective detachment of the first and second axial ends of one of the plurality of tubes enables said one of the plurality of tubes to be removed and replaced.

29. The shelter of claim 27 including a bottom member coupled to the plug, wherein the first sleeve is captured between the bottom member and the annular ring.

30. The shelter of claim 29 wherein the annular ring has a tapered inner circumferential surface, wherein the plug has a tapered outer circumferential surface and wherein the bottom member is coupled to the plug by a movable member such that movement of the movable member draws the plug against the ring to compress the first tube therebetween.

* * * * *